US010134216B2

(12) United States Patent
Frye

(10) Patent No.: US 10,134,216 B2
(45) Date of Patent: Nov. 20, 2018

(54) BILL MAGAZINE WITH AN ANTI-STRING FEATURE FOR USE WITH A VENDING MACHINE

(71) Applicant: David Frye, West End, NC (US)

(72) Inventor: David Frye, West End, NC (US)

( * ) Notice: Subject to any disclaimer, the term of this patent is extended or adjusted under 35 U.S.C. 154(b) by 0 days.

(21) Appl. No.: 15/692,797

(22) Filed: Aug. 31, 2017

(65) Prior Publication Data

US 2018/0261034 A1 Sep. 13, 2018

Related U.S. Application Data

(60) Provisional application No. 62/468,018, filed on Mar. 7, 2017.

(51) Int. Cl.

| | |
|---|---|
| ***G07D 11/00*** | (2006.01) |
| ***G07F 1/04*** | (2006.01) |
| *G07F 7/04* | (2006.01) |

(52) U.S. Cl.

CPC ..... *G07F 1/044* (2013.01); *G07D 11/0018* (2013.01); *G07D 11/0081* (2013.01); *G07F 7/04* (2013.01)

(58) Field of Classification Search

CPC ..... G07D 11/00; G07D 11/0018; G07D 11/0016; G07D 11/009; G07D 11/0093; G07D 11/0096

USPC ..... 194/203; 232/63

See application file for complete search history.

(56) References Cited

U.S. PATENT DOCUMENTS

| | | | | |
|---|---|---|---|---|
| 343,120 | A * | 6/1886 | Friede et al. | G07F 9/06 232/57 |
| 4,930,631 | A * | 6/1990 | Bruno | A61B 50/362 206/366 |
| 5,756,985 | A | 5/1998 | Holste et al. | |
| 6,698,569 | B2 | 3/2004 | Kaehler | |
| 7,007,789 | B2 | 3/2006 | Singleton, III | |
| 7,886,888 | B1 | 2/2011 | Chien et al. | |
| 2015/0279146 | A1 * | 10/2015 | Bird | G07F 1/041 194/203 |

* cited by examiner

*Primary Examiner* — Mark J Beauchaine

(74) *Attorney, Agent, or Firm* — Coats & Bennett, PLLC

(57) ABSTRACT

A bill magazine for a vending machine that is configured to prevent bills from being removed from the magazine. The magazine includes an interior space sized to hold the bills. Blades are positioned along the magazine. The blades contact against the top-most bill in the magazine. The blades include teeth that engage with the bill in the event there is an attempt to remove it from the magazine.

20 Claims, 7 Drawing Sheets

BILL MAGAZINE WITH AN ANTI-STRING FEATURE FOR USE WITH A VENDING MACHINE

CROSS-REFERENCE TO RELATED APPLICATIONS

The present application claims the benefit of U.S. Provisional Application No. 62/468,018 filed on Mar. 7, 2017, which is hereby incorporated by reference in its entirety.

BACKGROUND

"Stringing" is a term applied to a way to cheat bill validators in a vending machine. It is the process in which an elongated string such as tape, string or other devices is attached to paper currency, such as a dollar bill. The doctored bill is then inserted into the bill validator in the vending machine with the end of the elongated string remaining on the exterior of the vending machine. The doctored bill moves through the validator and is stored in a bill magazine and credit is given for the inserted bill. Once credited, the end of the string that remains on the exterior of the vending machine is pulled to remove the doctored bill so it may be used over and over. The same doctored bill may be used many times to obtain credit from the machine.

A variety of different attempts have been used to try to prevent stringing. One includes a catch positioned at the insert end of the magazine. The catch has a number of extensions that face inward into the interior of the magazine where the bills are stored. The concept is for the catch to engage with the bill and/or the string in an attempt to remove the bill from the magazine. However, the catch only has limited success as it does not engage with the string or the bill in many instances. Thus, the bill can still be removed from the magazine by pulling on the string that extends out of the vending machine.

SUMMARY

The present application is directed to a device to prevent a cheater from taking bills from a magazine of a vending machine. The device includes blades that are positioned on the magazine. The blades contact against the top-most bill in the magazine. The blades include teeth that engage with the bill in the event that it is attempted to be removed from the magazine.

One embodiment is directed to a magazine to hold bills in a vending machine. The magazine includes a body with an interior space sized to hold the bills. The body includes a floor and side walls that extend upward from the floor around the interior space. The side walls include an inlet side wall and a second side wall on opposing ends of the body, and opposing lateral side walls that extend between the inlet side wall and the second side wall. Blades extend along the lateral side walls and include teeth that extend into the interior space. Each of the teeth includes opposing first and second sides that intersect at a tip.

The teeth may each include an insertion orientation angle formed between a line that extends through the tip and a center point of a root, and an insertion direction. The insertion orientation angle may be in the range of 15°-90° so the tip is positioned away from the inlet side wall of the body.

The lateral side walls may be longer than the inlet side wall and the second side wall Each of the teeth may include a symmetrical shape.

Each of the blades may include a base with a flat side that is positioned against one of the lateral side walls with the teeth of each of the blades extending outward from the base.

Each of the blades may include that the base and the teeth are a unitary piece.

The tips of each of the teeth may be aligned in a first plane that is parallel to a second plane that extends through the base.

The teeth of each of the blades may include a common shape and size.

The magazine may be plastic and the blades may be metal.

Each of the blades may extend along a limited length of the interior space.

Another embodiment is directed to a magazine to hold bills in a vending machine. The magazine includes a body with an interior space sized to hold the bills. The body includes a floor and side walls that extend from the floor around the interior space. The side walls include first and second side walls at opposing ends of the body and opposing first and second lateral side walls that extend between the first and second side walls. A first blade is on the first lateral side wall and a second blade is on the second lateral side wall. Each of the blades includes a base with a length that extends between a first end and a second end and teeth that extend outward from the base towards the interior space. Each of the teeth include opposing first and second sides that intersect at a tip with the tip facing away from the first side wall of the body.

The teeth may each include an insertion orientation angle formed between a line that extends through the tip and a center point of a root and an insertion direction with the insertion orientation angle being in the range of 15°-90° so the tip is positioned away from the first side wall of the body.

The first lateral side wall may include a first ledge that extends over the interior space and the second lateral side wall may include a second ledge that extends over the interior space. The first and second ledges may be spaced apart with an opening formed therebetween. The first blade may be positioned on a bottom of the first ledge and with the teeth facing inward towards the interior space and the second blade may be positioned on a bottom of the second ledge and with the teeth facing inward towards the interior space.

The lateral side walls may be longer than the first and second side walls.

The blades may be integrally formed with the body.

The tips of each of the teeth may be aligned in a first plane that is parallel to a second plane that extends through the base.

The teeth of each of the blades may include a common shape and size.

Each of the blades may extend along an entire length of the interior space.

Another embodiment is directed to a magazine to hold bills in a vending machine. The magazine includes a body with an interior space sized to hold the bills with the body including a floor and side walls that extend from the floor around the interior space. The side walls include first and second side walls at opposing ends of the body and opposing first and second lateral side walls that extend between the first and second side walls. The first and second side walls at the opposing ends of the body are shorter than the first and second lateral side walls. The magazine includes at least one blade on one of the first and second lateral side walls. The blade includes a base with a length that extends between a first end and a second end and teeth that extend outward from the base towards the interior space. Each of the teeth includes opposing first and second sides that intersect at a tip.

The blade may extend along a limited section of the one of the first and second lateral side walls.

The various aspects of the various embodiments may be used alone or in any combination, as is desired.

DETAILED DESCRIPTION

The present application is directed to a magazine for a vending machine that is configured to prevent bills from being removed during a stringing attempt. The magazine includes an interior space sized to hold the bills. Blades are positioned along the magazine. The blades contact against the top-most bill in the magazine. The blades include teeth that engage with the bill in the event there is an attempt to remove it from the magazine.

Figure 1:
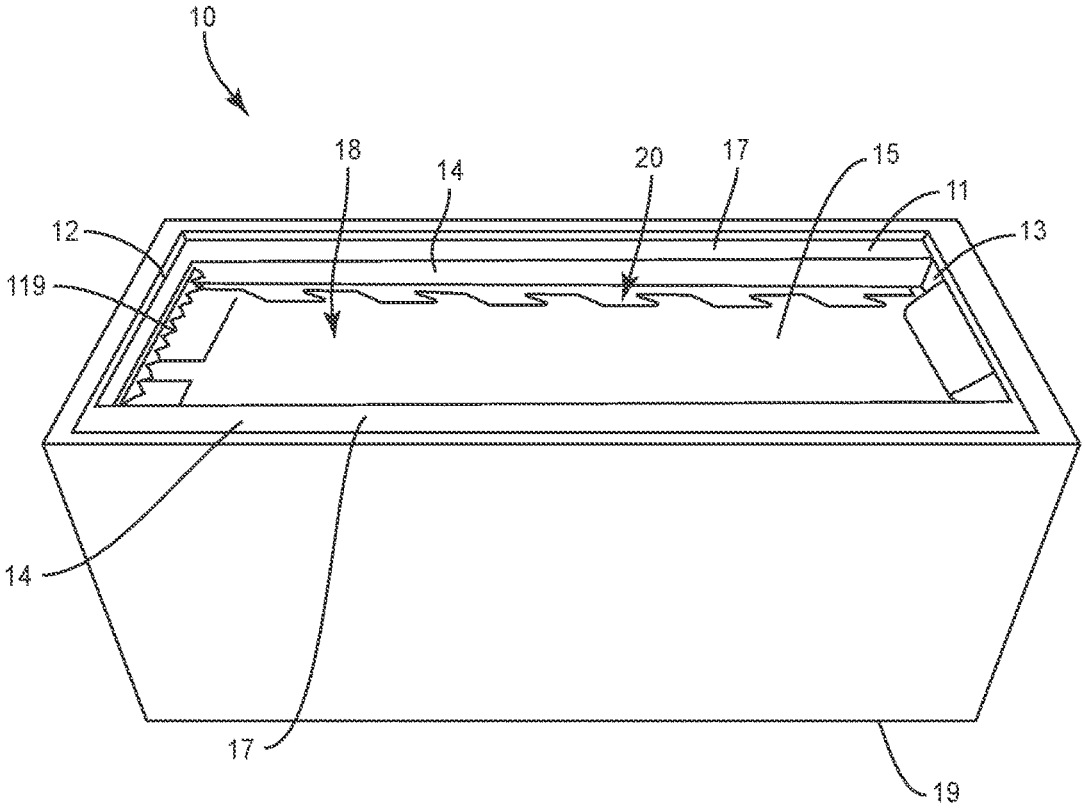
FIG. 1 is a perspective view of a magazine with blades positioned at the lateral side walls.

FIG. 1 illustrates a magazine 10 configured to receive bills in a vending machine. The magazine 10 includes a floor 19 with side walls that extend upward and form an interior space 18 that receives the bills. The side walls include an inlet side wall 12, opposing back side wall 13, and opposing lateral side walls 14. A top 11 is open such that the bills can be inserted into the interior space 18 of the magazine 10. Blades 20 extend along each of the lateral side walls 14 and extend downward into the interior space 18 to contact against the top-most bill in the magazine 10. The blades 20 include a series of teeth 25 with tips that are shaped to prevent a bill from being removed from the magazine 10 over the inlet side wall 12.

Figure 2:
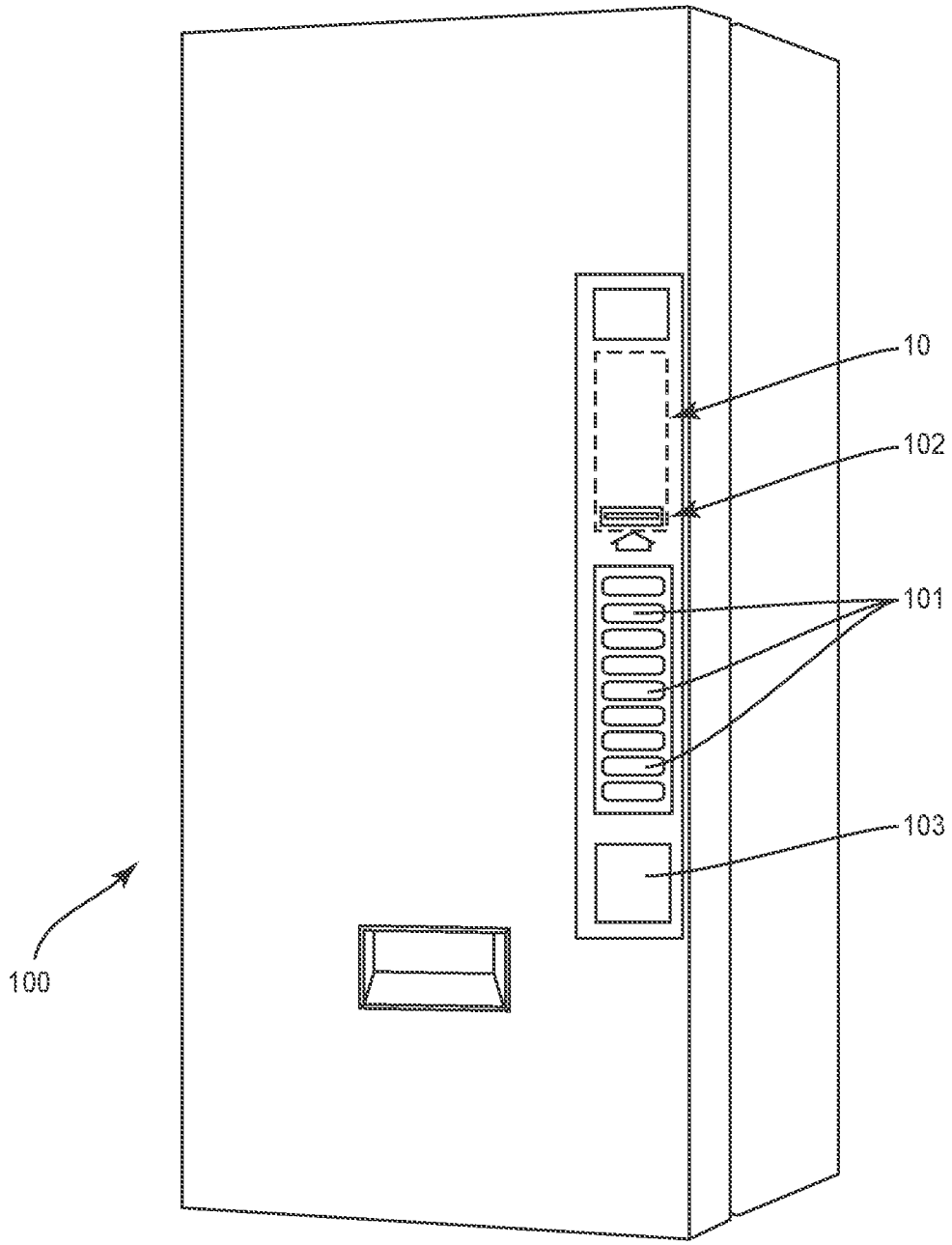
FIG. 2 is a perspective view of a vending machine with the magazine within the interior of the machine illustrated in dashed lines.

FIG. 2 illustrates the magazine 10 used with a vending machine 100. The user is required to input payment, such as by inserting one or more bills through a bill receiver 102. The one or more bills are verified by the machine 100 and credit is given to the user. The user is then able to press one or more buttons 101 to select their desired item, such as a drink or food. The selected item is then dispensed to the user through an opening 103.

The bill receiver 102 is sized for the user to insert their bill into the vending machine 100 when it is in a flat orientation. The bill is verified by the machine 100 and stored in the magazine 100 in the interior of the machine 100 (illustrated in dashed lines in FIG. 2).

Figure 3:
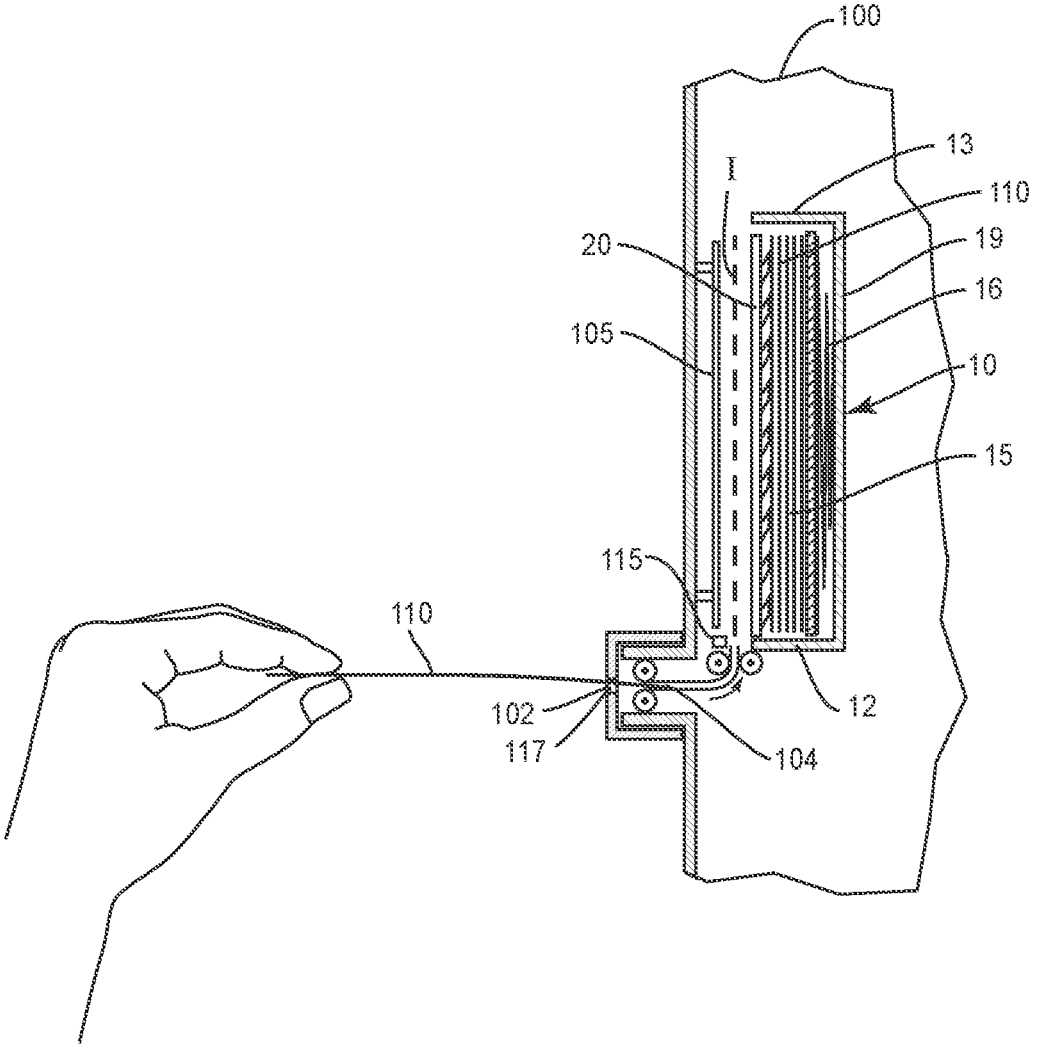
FIG. 3 is a side sectional view of a magazine located within the interior of a vending machine.

FIG. 3 illustrates the bill receiver 102 and the magazine 10. The bill receiver 102 includes the opening 117 to receive the bill 110 and a passage 104 along which the bill 110 travels to the magazine 10. The passage 104 may include one or more rollers, belts, and the like to pull the bill 110 into the machine 100 and move the bill 110 along the passage to the magazine 10. The magazine 10 is positioned in the machine 100 with the inlet side wall 12 positioned at the end of the passage 104. Thus, a bill 110 moving along the passage 104 travels over the inlet side wall 12 in an insertion direction I. A push plate 105 is positioned at the magazine 10 to move the bills 110 through the open top side 11 and into the interior space 18 and below the blades 20. The magazine 10 may also include a movable floor 15 that is biased towards the top side 11 by one or more biasing members 16. This may keep the top-most bill 110 in contact against the teeth 25 of the blades 20.

The blades 20 are positioned along each of the lateral side walls 14 to contact against the top-most bill 110 in the magazine 10. That is, a first blade 20 extends along the first lateral side wall 14 and a second blade 20 extends along the second lateral side wall 14. The blades 20 may have the same or different lengths and/or sizes. Further, the teeth 25 on the blades 20 may be the same or different.

The blades 20 may be separate from the magazine 10 and attached to the side walls 14. The attachment may include one or more of adhesives, adhesive tape, and mechanical fasteners such as rivets, screws, bolts, etc. One specific embodiment includes attachment by double-sided tape available from 3M Corporation. The magazine 10 and blades 20 may be constructed from the same or different materials. One design includes the magazine constructed from a hardened plastic and the blades 20 constructed from metal, such as aluminum or steel.

The blades 20 and magazine 10 may also be formed as a single, unitary piece. The blades 20 and magazine 10 are constructed from the same material.

As illustrated in FIG. 1, the blades 20 are positioned on the magazine 10 for the teeth 25 to contact against the top-most bill 110. In one embodiment, the blades 20 are attached directly to the lateral side walls 14. Another embodiment as illustrated in FIG. 1 includes each of the lateral side walls 14 having a ledge 17 that extends over the interior space 18. The ledges 17 are spaced apart by the open top side 11. The blades 20 are positioned on a bottom of the ledge 17 that faces into the interior space 18. This positions the blades 20 directly over the bills 110 and configured to contact against the top-most bill 110.

Figure 4:
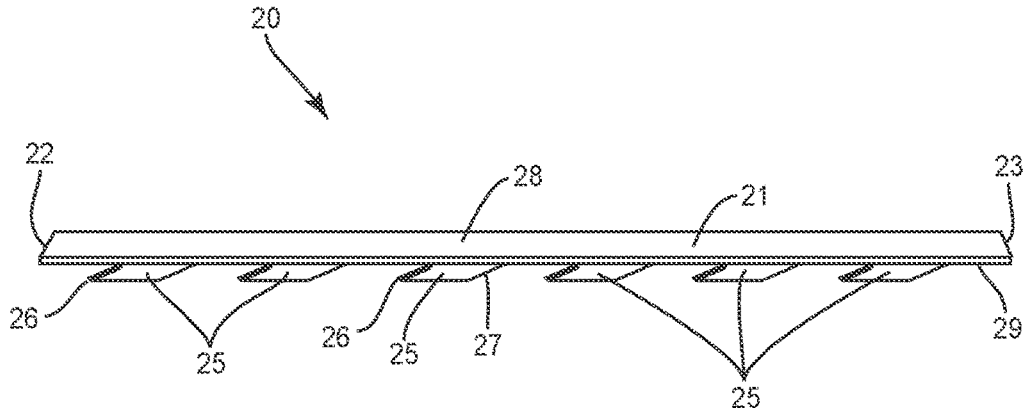
FIGS. 4 and 5 are perspective views of a blade.
Figure 5:
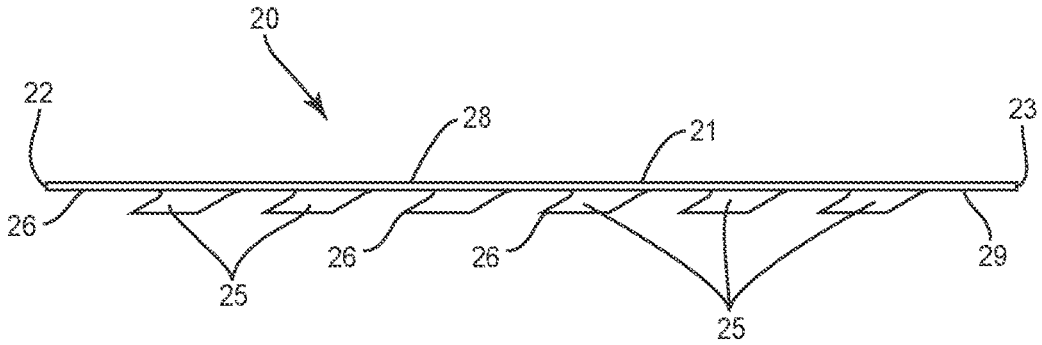

FIGS. 4 and 5 illustrate exemplary blades 20 that are positioned along the lateral side walls 14. Each blade 20 includes a length that is measured between a first end 22 and a second end 23. The length may be equal to the length of the interior space 18 such that the blade 20 extends along the entire length of the interior space 18. The blades 20 may also be shorter such that they do not extend the entire length of the interior space 18.

The blade 20 includes a base 21 and outwardly extending teeth 25. The base 21 includes a surface 28 that abuts against and the magazine 10. The surface 28 may be flat to facilitate the contact between the blade 20 and the magazine 10. In one design as illustrated in FIG. 1, the surface 28 abuts against the bottom side of the ledge 17. As illustrated in FIG. 5, the base 21 may have a substantially planar shape with flat opposing surfaces 28, 29. The base 21 may include a consistent thickness along the length such that surfaces 28, 29 are parallel with one another. Other embodiments may include a variable thickness along the length.

The teeth 25 extend outward from the base 21. The teeth 25 may be cut or otherwise formed along one side of the base 21. The teeth 25 also angle outward from the base 21 to contact against the bill 110 when one of the surfaces 28, 29 is positioned against the magazine 10.

Figure 6:
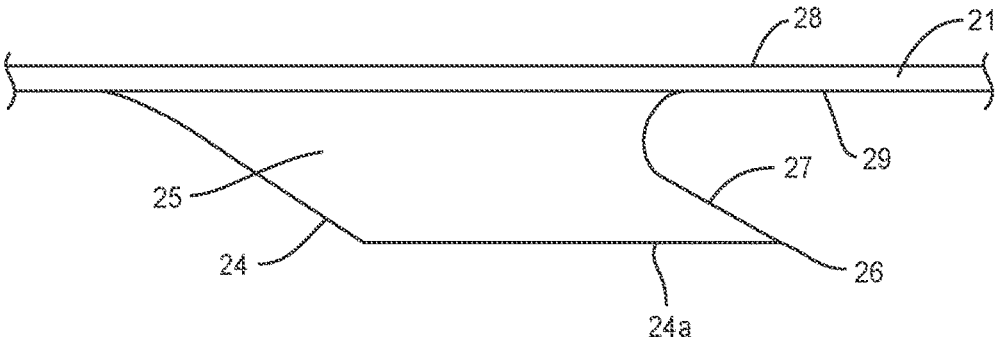
FIG. 6 is a side view of a tooth of a blade.

FIG. 6 illustrates a tooth 25 that extends outward beyond the bottom side 29 of the base 21. Each tooth 25 includes a first side 24 and a second side 27 that intersect at a tip 26. The sides 24, 27 may have different configurations, including but not limited to being straight, curved, formed by multiple different sections, etc. FIG. 6 includes the first side 24 formed by two straight sections, and the second side 27 having a curved shape. The blade 20 is positioned in the magazine 10 such that tips 26 face away from the inlet side wall 12 and towards the back side wall 13. This positioning is visible in FIG. 1 with the tips 26 of the teeth 25 facing away from the inlet side wall 12. This positioning provides for the tips 26 to engage with a bill 110 when it starts moving towards the insert side wall 12 during a stringing attempt.

In one embodiment as illustrated in FIG. 6, the first side 24 of the teeth 25 includes an elongated straight edge (illustrated as 24*a*). This edge 24*a* provides an extended contact surface that contacts against the bill 110 in the magazine 10.

Figure 7:
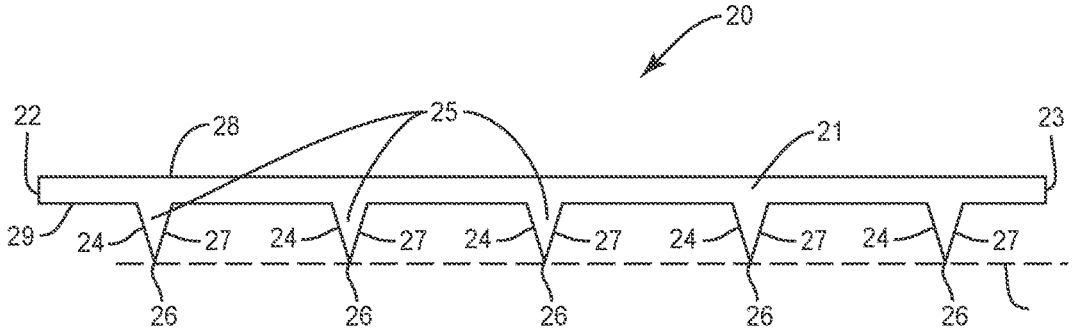
FIG. 7 is a side view of a blade.
Figure 8:
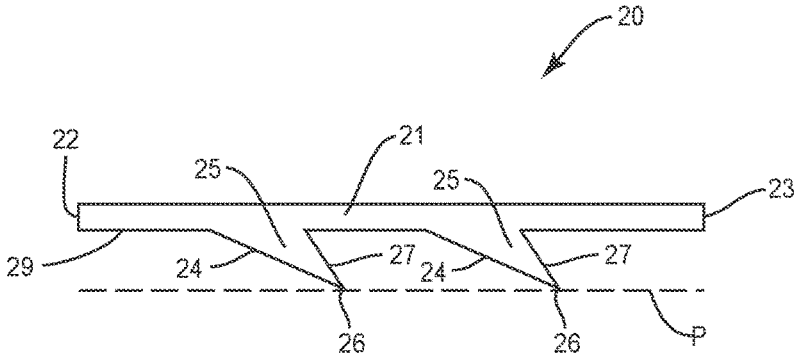
FIG. 8 is a side view of a blade.

FIG. 7 illustrates a blade 20 with teeth 25 positioned along the length. Each of the teeth 25 is substantially the same with first and second sides 24, 27 that terminate at a tip 26. The tip 26 is positioned to face away from the first end 22 of the blade 20 that is positioned at the inlet side wall 12. FIG. 8 includes a blade 20 with teeth 25 randomly spaced along the length between the ends 22, 23. The teeth 25 include different shapes and sizes with the tips 26 positioned to face away from the first end 22 that is positioned at the inlet side wall 12.

As illustrated in FIGS. 7 and 8, each of the tips 26 of the teeth 25 may extend outward from the base 21 an amount to be located along a common plane P. In one design, the plane P is parallel with a plane that extends through the surface 28.

Figure 9A:
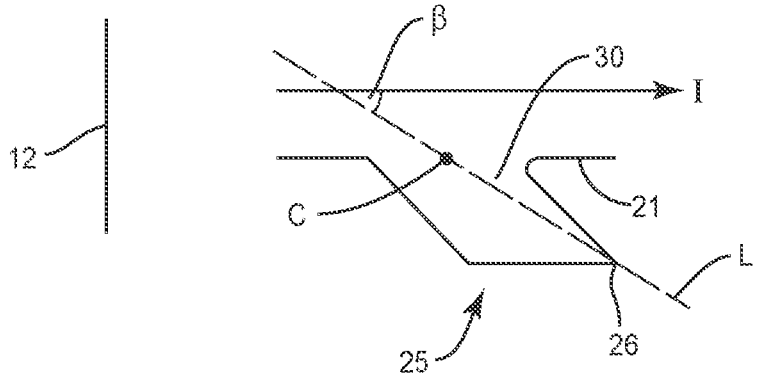
FIG. 9A is a schematic view of a tooth and an insertion orientation angle.
Figure 9B:
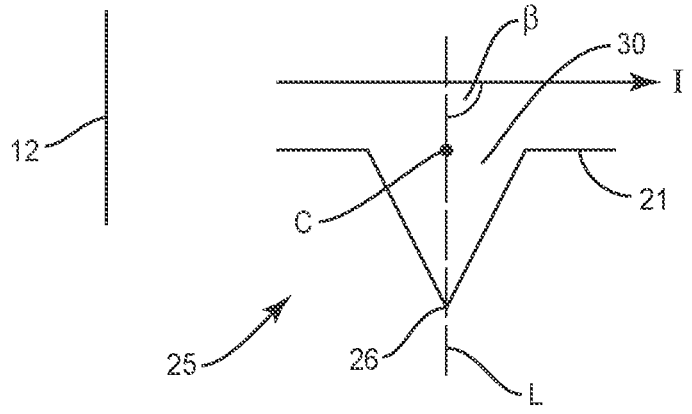
FIG. 9B is a schematic view of a tooth and an insertion orientation angle.

The teeth 25 may include an insertion orientation angle 1 such that the tips 26 of the teeth 25 face away from the insert side wall 12 when the blade 20 is positioned in the magazine 10. As illustrated in FIGS. 9A and 9B, each of the teeth 25 includes a root 30 where it connects with the base 21. The root 30 includes a center point C along its length. Further, an insertion line I represents the direction the bill 110 moves during insertion over the insert side wall 12 and along the magazine 10 (see FIG. 3). A line L that extends through the center point C and the tip 26 of the tooth 25 forms the insertion orientation angle ß with the insertion line I. The tip 26 faces away from the insert side wall 12 such that the angle ß is between 15°-90°. This provides for the tip 26 to engage with the bill 110 in the event it is attempted to be removed from the magazine 10.

The teeth 25 may be formed by one or more separate components that are attached to the base 21. This may include the teeth 25 being constructed from a different material than the base 21. Alternatively, the teeth 25 may be integral with the base 21 such that the entire blade 20 is a single, integral piece.

Figure 10:
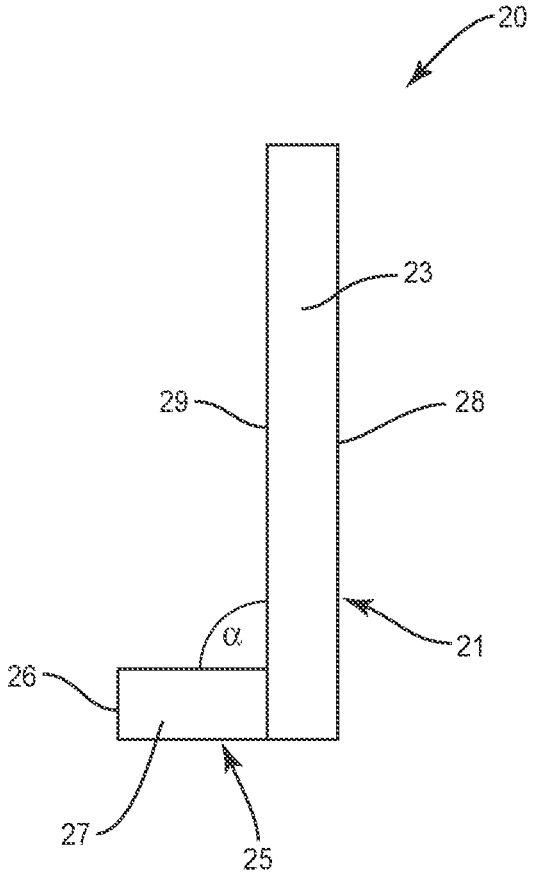
FIG. 10 is an end view of a blade.

The teeth 25 may be bent or otherwise angled outward from the base 21. FIG. 10 illustrates an end view of a blade 20. The teeth 25 extend outward from the base 21 at an angle α. This angle α may range from between 15-165 degrees, with FIG. 10 including a design with the angle α being 90°. Each of the teeth 25 are aligned and extend from the base 21 such that just the first tooth 25 is visible in the end view of FIG. 10.

The blades 20 may be configured to be attached to an existing magazine 10. This includes a first blade 20 being aligned along and attached to the first lateral side wall 14. A second blade 20 is aligned along and attached to the second lateral side wall 14. The blades 20 may extend along the entire length of the magazine 10, or a limited length. Each of the blades 20 may be positioned at the same location along the length of the magazine 10, or the blades 20 may be offset to at least partially extend along different lengths.

The blades 20 may also be integrally formed with the magazine 10. This may include the magazine 10 with the blades 20 being formed in the same operation, such as but not limited to the same molding or same forming or same 3-D printing operation.

In use as illustrated in FIG. 3, the bill 110 is inserted into the bill receiver 102 and moved along the interior passage 104. The bill 110 moves over the insertion end 12 in the insertion direction I and aligns with the open top 11 of the magazine 10. The push plate 105 pushes the bill 110 down into the interior space 18 of the magazine 10 and below the blades 20. The biasing member 16 may maintain the bill 110 in contact with the teeth 25 on the blades 20.

In the event the bill 110 is attempted to be removed through stringing, the bill 110 is pulled in the direction of the insert side wall 12. The movement causes the teeth 25 to bite into the bill 110. This prevents the bill 110 from being removed from the magazine 10. If the bill 110 is attempted to be pulled beyond the teeth 25, the bill 110 will either rip or the string that is attached to the bill will break. In either event, the bill 110 is not removed from the vending machine 100.

A sensor 115 (see FIG. 3) may be positioned within the vending machine 100 at the magazine 10 and/or along the passage 105. When the bill 110 is attempted to be removed from the magazine 10, the bill 110 will be damaged and/or stuck along the passage 105. The sensor 115 detects this occurrence and determines an error condition that will shut down the machine 100 and require maintenance.

Further, the blades 20 result in the doctored bill 110 remaining within the vending machine 100. This prevents its use in stringing other machines 100. If the bill 110 or a portion of the bill 110 is able to be removed from the machine 100, it is damaged to an extent that it is unusable to string other machines 100.

The magazine 10 may be used in a variety of different vending machines. This includes but is not limited to food vending machines and drink vending machines, vending machines that provide tokens, such as those used in video arcades and casinos, and vending machines that provide tickets, such as at a subway or train station.

The blades 20 further facilitate the use of a catch 119 that may be included in the magazine 10. As illustrated in FIG. 1, the catch 119 includes extensions (e.g., teeth, fingers) that extend from the insert side wall 12 into the interior space 18. The catch 119 is designed to snag a bill 110 that is attempted to be removed from the magazine 10, or the string that is attached to the bill 110. However, the top-most bill 110 in the magazine 10 is often positioned in close proximity to the catch 119. This prevents the catch 119 from engaging with the bill 110 and/or string during an attempted removal. As illustrated in FIG. 1, the teeth 25 are sized and positioned to locate the top-most bill 110 deeper into the interior space 18. This deeper positioning makes it more likely that the bill 110 and/or string will engage with the catch 119 during an attempted removal.

The magazine 10 may include blades 20 extending along each of the lateral side walls 14. The magazine 10 may also include a single blade 20 extending along one of the lateral side walls 14.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A magazine to hold bills in a vending machine, the magazine comprising:

a body with an interior space sized to hold the bills, the body including a floor and side walls that extend upward from the floor around the interior space, the side walls comprising an inlet side wall and a second side wall on opposing ends of the body and opposing lateral side walls that extend between the inlet side wall and the second side wall;

blades that extend along the lateral side walls and include teeth that extend into the interior space, each of the teeth includes opposing first and second sides that intersect at a tip, the blades extending downward into the interior space;

the floor positioned below the blades and being movable and biased upwards towards a top of the interior space to maintain a top-most one of the bills in contact against the teeth.

2. The magazine of claim 1, wherein the teeth each include an insertion orientation angle formed between a first line that extends through the tip and a center point of a root and a second line that extends along an insertion direction, the insertion orientation angle being in the range of 15°-90° so the tip is positioned away from the inlet side wall of the body.

3. The magazine of claim 2, wherein each of the teeth includes a symmetrical shape.

4. The magazine of claim 1, wherein the lateral side walls are longer than the inlet side wall and the second side wall.

5. The magazine of claim 1, wherein each of the blades further includes a base with a flat side that is positioned against one of the lateral side walls, the teeth of each of the blades extending outward from the base.

6. The magazine of claim 1, wherein each of the blades that comprises the base and the teeth is a unitary piece.

7. The magazine of claim 1, wherein the tips of each of the teeth are aligned in a first plane that is parallel to a second plane that extends through the base.

8. The magazine of claim 1, wherein the teeth of each of the blades include a common shape and size.

9. The magazine of claim 1, wherein the magazine is plastic and the blades are metal.

10. The magazine of claim 1, wherein each of the blades extends along a limited length of the interior space.

11. A magazine to hold bills in a vending machine, the magazine comprising:

a body with an interior space sized to hold the bills, the body including a floor and side walls that extend from the floor around the interior space, the side walls comprising first and second side walls at opposing ends of the body and opposing first and second lateral side walls that extend between the first and second side walls;

a first blade on the first lateral side wall and a second blade on the second lateral side wall, each of the blades including a base with a length that extends between a first end and a second end and teeth that extend outward from the base towards the interior space, each of the teeth including opposing first and second sides that intersect at a tip with the tip facing away from the first side wall of the body;

the floor positioned below the blades and being movable and biased upwards towards a top of the interior space to maintain a top-most one of the bills in contact against the teeth.

12. The magazine of claim 11, wherein the teeth each include an insertion orientation angle formed between a first line that extends through the tip and a center point of a root and a second line that extends along an insertion direction, the insertion orientation angle being in the range of 15°-90° so the tip is positioned away from the first side wall of the body.

13. The magazine of claim 11, wherein the first lateral side wall includes a first ledge that extends over the interior space and the second lateral side wall includes a second ledge that extends over the interior space, the first and second ledges being spaced apart with an opening formed therebetween, the first blade being positioned on a bottom of the first ledge and with the teeth facing inward towards the interior space and the second blade being positioned on a bottom of the second ledge and with the teeth facing inward towards the interior space.

14. The magazine of claim 11, wherein the lateral side walls are longer than the first and second side walls.

15. The magazine of claim 11, wherein the blades are integrally formed with the body.

16. The magazine of claim 11, wherein the tips of each of the teeth are aligned in a first plane that is parallel to a second plane that extends through the base.

17. The magazine of claim 11, wherein the teeth of each of the blades include a common shape and size.

18. The magazine of claim 11, wherein each of the blades extends along an entire length of the interior space.

19. A magazine to hold bills in a vending machine, the magazine comprising:

a body with an interior space sized to hold the bills, the body including a floor and side walls that extend from the floor around the interior space, the side walls comprising first and second side walls at opposing ends of the body and opposing first and second lateral side walls that extend between the first and second side walls;

the first and second side walls at the opposing ends of the body being shorter than the first and second lateral side walls;

at least one blade on one of the first and second lateral side walls, the blade comprising a base with a length that extends between a first end and a second end and teeth that extend outward from the base towards the interior space, each of the teeth including opposing first and second sides that intersect at a tip with the tip facing away from one of the first and second side walls;

the floor positioned below the at least one blade and being movable and biased upwards towards a top of the interior space to maintain a top-most one of the bills in contact against the teeth.

20. The magazine of claim 19, wherein the blade extends along a limited section of the one of the first and second lateral side walls.

* * * * *